US006598450B2

(12) United States Patent
Blue

(10) Patent No.: US 6,598,450 B2
(45) Date of Patent: Jul. 29, 2003

(54) INTERNALLY COOLED PUNCH

(75) Inventor: Rodney Blue, Huntington Beach, CA (US)

(73) Assignee: Sequa Can Machinery, Inc., East Rutherford, NJ (US)

( * ) Notice: Subject to any disclaimer, the term of this patent is extended or adjusted under 35 U.S.C. 154(b) by 0 days.

(21) Appl. No.: 10/003,641

(22) Filed: Nov. 2, 2001

(65) Prior Publication Data

US 2003/0084699 A1 May 8, 2003

(51) Int. Cl.[7] ..... B21D 37/16
(52) U.S. Cl. ..... 72/342.3; 72/347; 72/349
(58) Field of Search ..... 72/342.3, 347, 72/349

(56) References Cited

U.S. PATENT DOCUMENTS

| | | | | | |
|---|---|---|---|---|---|
| 3,049,947 | A | * | 8/1962 | Milnes | 72/463 |
| 3,455,137 | A | * | 7/1969 | Edgecombe | 72/264 |
| 3,577,753 | A | * | 5/1971 | Shah et al. | 72/41 |
| 3,908,429 | A | * | 9/1975 | Gram | 72/349 |
| 4,502,313 | A | | 3/1985 | Phalin et al. | 72/342 |
| 5,048,592 | A | * | 9/1991 | Mueller | 164/312 |
| 5,233,912 | A | | 8/1993 | Mueller | 92/29 |
| 5,626,046 | A | | 5/1997 | Main | 72/273 |
| 5,678,442 | A | * | 10/1997 | Ohba et al. | 72/272 |
| 5,687,604 | A | | 11/1997 | Robbins | 72/265 |
| 6,035,688 | A | | 3/2000 | Nagao et al. | 72/342.3 |
| 6,216,511 | B1 | * | 4/2001 | Ohnishi et al. | 72/113 |

FOREIGN PATENT DOCUMENTS

| | | | | |
|---|---|---|---|---|
| DE | 2519137 A | * | 11/1976 | B29C/17/07 |
| IT | 0499298 A | * | 11/1955 | |

* cited by examiner

*Primary Examiner*—Allen Ostrager
*Assistant Examiner*—John S Goetz
(74) *Attorney, Agent, or Firm*—Mitchell D. Bittman; Robert C. Faber

(57) ABSTRACT

An internally cooled punch disposed on the end of a ram in a can forming machine. Internal fluid cooling means in the ram avoids the need for externally applied cooling fluids. A plurality of parallel fluid transfer tubes is arranged annularly within the ram. Cooling medium flows through inlet tubes to radial inlet ports which supply the cooling medium to the inner surface of the punch where the medium flows rearwardly through a channel at the inner surface of the punch to radial outlet ports leading to outlet tubes through the ram. Discharged cooling media flows back along the ram and out through a manifold. The transfer tubes are arranged symmetrically in an alternating array circumferentially around the ram to reduce radial temperature gradients within the ram. A central port allows air flow through the ram to aid in stripping the formed container from the punch.

12 Claims, 4 Drawing Sheets

INTERNALLY COOLED PUNCH

BACKGROUND OF THE INVENTION

1. Field of the Invention

The present invention relates generally to punches useful in forming cans from cups and particularly for two piece can forming, and more specifically to such punches that are internally cooled.

2. Brief Description of the Related Art

Forming machines are used to form the bodies of metal containers. A shallow metal cup is driven through a set of annular forming dies by a punch to form the more elongate body of the can, e.g. in a known drawing and ironing process. An example of a conventional can forming machine is shown in U.S. Pat. No. 4,173,882 issued to Lee, Jr. on Nov. 13, 1979, the entire disclosure of which is incorporated herein by reference.

A separate punch typically is removably secured on the leading end of a reciprocating ram in a drawing and ironing machine. The punch provides an inner mandrel on which the can is shaped, drawn, and ironed as it passes through successive dies. The temperature of the punch should be controlled against the heat generated in the punch by repeated frictional contact between the punch, the inside of the can body, and the dies past which the punch moves.

In conventional can formation, externally applied cooling fluids maintain operational temperature conditions. In some can forming applications, however, it is desirable to exclude the conventional use of external cooling fluids. The external cooling fluids may contaminate the container surfaces which would then require post-formation cleaning processes that are costly and may be environmentally undesirable.

Prior arrangements internally cool a punch. U.S. Pat. No. 4,502,313 to Phalin et al., discloses a single coolant inlet passage and a single coolant outlet passage which allow a coolant liquid to flow through a spiral groove adjacent the interior of the punch. U.S. Pat. No. 5,687,604 to Robbins, U.S. Pat. Nos. 5,233,912 and 5,048,592 to Mueller, and U.S. Pat. No. 5,678,442 to Ohba et al. disclose cooling fluid supply and discharge tubes through central conduits. U.S. Pat. No. 6,035,688 to Nagao et al. utilizes a single, continuous passage to supply coolant. The prior art systems are disadvantageous because they do not minimize circumferential direction temperature gradients within the ram and do not provide uniform cooling of the punch.

SUMMARY OF THE INVENTION

The present invention overcomes disadvantages of prior art internally cooled punches by supplying fluid, and particularly liquid coolant, through a plurality of annularly arranged fluid transfer tubes to radially arranged ports. Each port feeds into a circumferential channel adjacent the interior surface of the punch that is disposed on and over the end region of the ram inside the punch. The internally cooled punch does not require the use of external cooling fluids. The external temperature of the punch can be monitored continuously, e.g. by direct contact with the punch or by monitoring the temperature of the fluid that cooled the punch, and the cooling fluid medium temperature can be adjusted automatically to maintain acceptable punch temperatures.

Cooling fluid medium is supplied by a temperature control unit and is delivered to the punch through a series of tubes running through the ram. Inlet tubes direct cooling medium toward the distal or leading end of the ram and the punch there. Outlet tubes located more proximally or rearward return the cooling medium out of the punch. Multiple parallel inlet and outlet tubes are spaced circumferentially and symmetrically around the periphery of the punch, with inlet and outlet tubes alternating to distribute the fluid media uniformly around the inner surface of the punch. The multiple fluid inlet and outlet design with symmetrical porting helps assure that the punch temperature remains constant, minimizing circumferential temperature gradients.

Preferably, the fluid transfer tubes are constructed from materials with low thermal transfer properties to minimize heat transfer to the wall of the ram inside the punch. Minimizing heat transfer between the fluid medium and the ram is desirable to maintain accurate fluid heat transfer between the fluid medium and the ram, accurate fluid media inlet temperatures and to minimize ram distortion due to thermal gradients. Circumferential thermal gradients in the ram may distort the ram, adversely altering punch alignment.

Porting between the transfer tubes is circumferentially symmetrical, with alternating inlet and outlet ports, to minimize any circumferential temperature gradients that could transfer to and distort the ram or the surface of the punch. The symmetrically alternating inlet and outlet ports uniformly distribute the fluid medium radially to the inner surface of the punch around the outside of the ram. The transfer tubes also surround a separate central port for air flow and aids that flow in stripping the container from the punch.

Other features and advantages of the present invention will become apparent from the following description of the invention which refers to the accompanying drawings.

DETAILED DESCRIPTION OF A PREFERRED EMBODIMENT OF THE INVENTION

Figure 1:
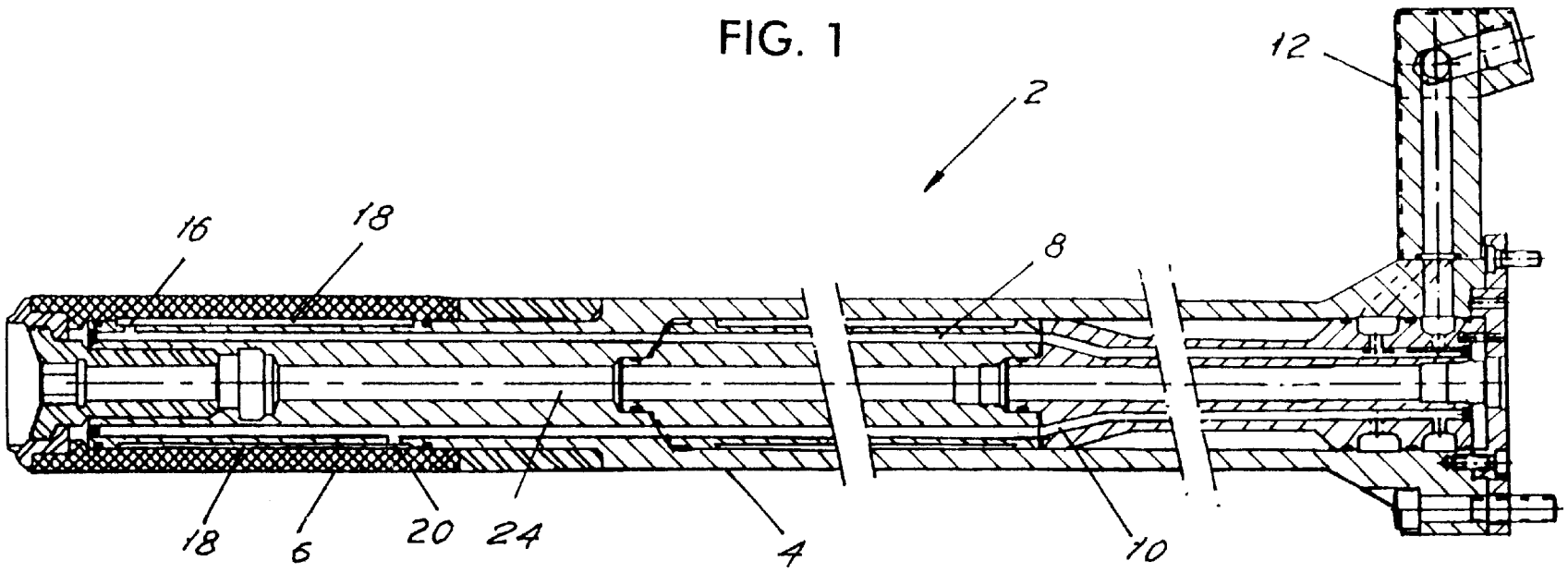
FIG. 1 is an elevational cross section of an internally cooled punch assembly according to the present invention.

FIG. 1 shows an internally cooled punch assembly 2 according to the present invention in cross section. The assembly includes a reciprocable ram 4 which is conventionally reciprocated through a series of dies (not shown) of a container forming tool assembly (not shown). Such a tool assembly may be seen in a copending application entitled "INTERNALLY COOLED TOOL PACK" and filed herewith. The distal, outer or leading end region of the ram is of narrowed external diameter. A punch 6 is removably disposed on the narrowed distal end region of the ram.

Figure 5:
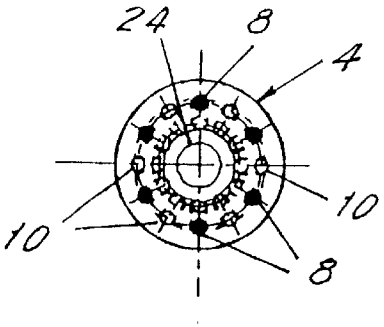
FIG. 5 is a cross section showing the proximal end of the punch assembly of FIG. 1 and illustrating fluid flow to the punch according to the present invention.

As seen in FIGS. 1 and 5, a plurality of fluid transfer inlet tubes 8 for supplying fluid cooling medium and a plurality of fluid transfer outer tubes 10 for discharging the cooling medium are formed within the ram 4, annularly in a circumferential, symmetrical arrangement, with tubes 8 and 10 alternating. A manifold 12 for connection to a temperature control unit 13 is provided on a proximal end of the punch assembly and connects to at least one of the tubes 8 and/or 10.

Figure 2:
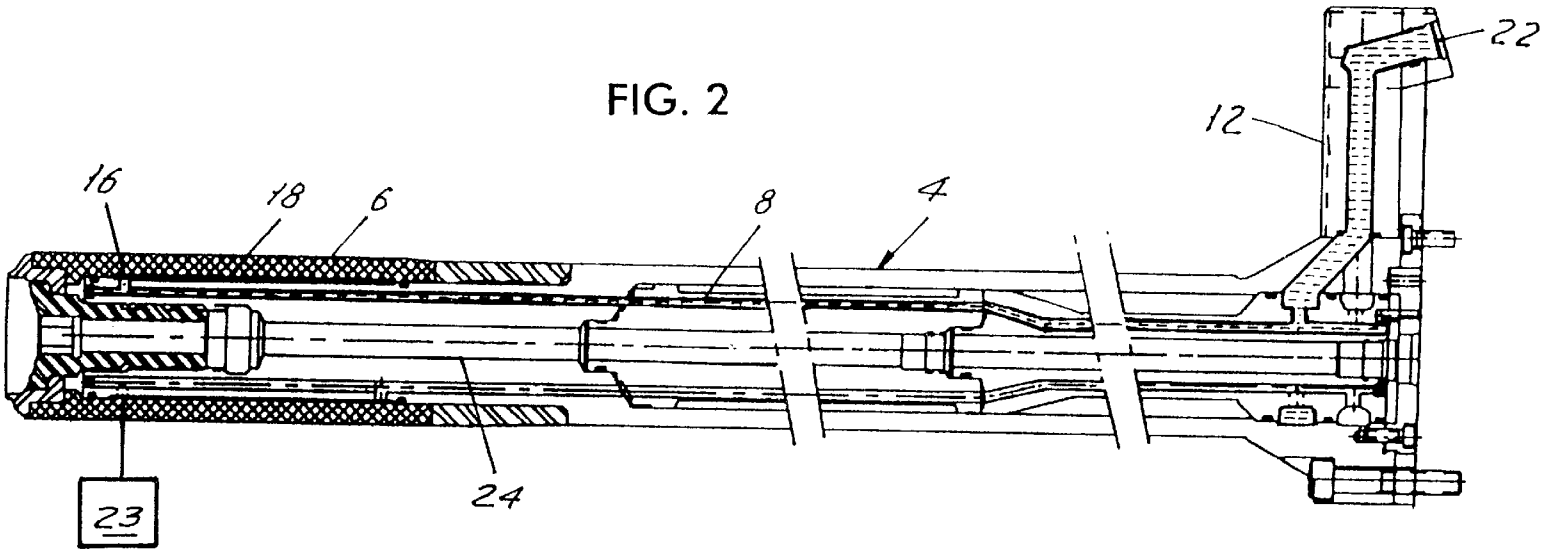
FIG. 2 is an elevational cross section of the punch assembly of FIG. 1 and illustrating cooling fluid medium pathways flowing into the assembly.
Figure 3:
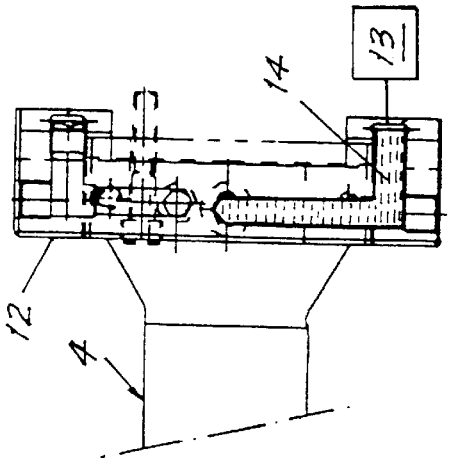
FIG. 3 is a cross sectional plan view detailing an inlet manifold of the punch assembly of FIG. 1.
Figure 4:
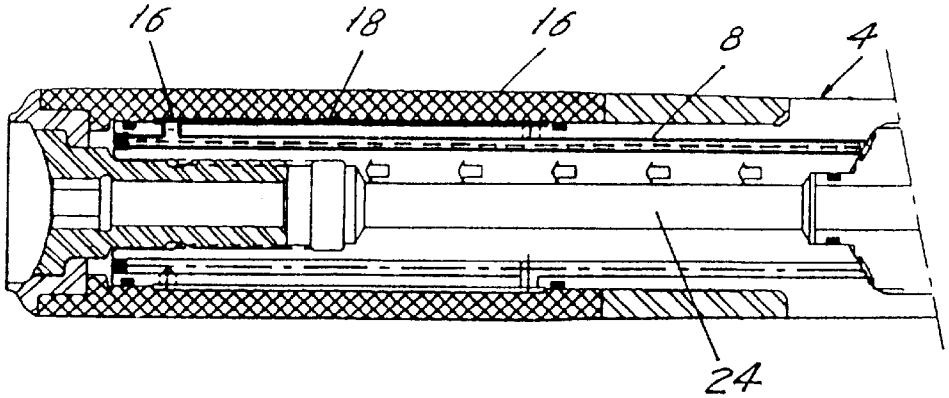
FIG. 4 is an enlarged view of the distal end of the punch assembly shown in FIG. 2 and illustrating the supply of fluid cooling medium.

FIGS. 2–5 show the supply of fluid cooling medium to the punch. FIG. 2 illustrates flow of cooling medium from a fluid medium temperature control unit 13 of conventional design (FIG. 3) into an inlet portion of manifold 12 into ram 4 toward the distal end along inlet transfer tubes 8 as shown by arrows in FIG. 4. The inlet portion 14 of manifold 12 is shown in FIG. 3. When the inlet portion 14 is nearly at the distal end, the cooling medium flows radially outward from tubes 8 through radial port 16 to a channel or clearance 18 extending along the inner or bore surface of the punch 6.

Figure 8:
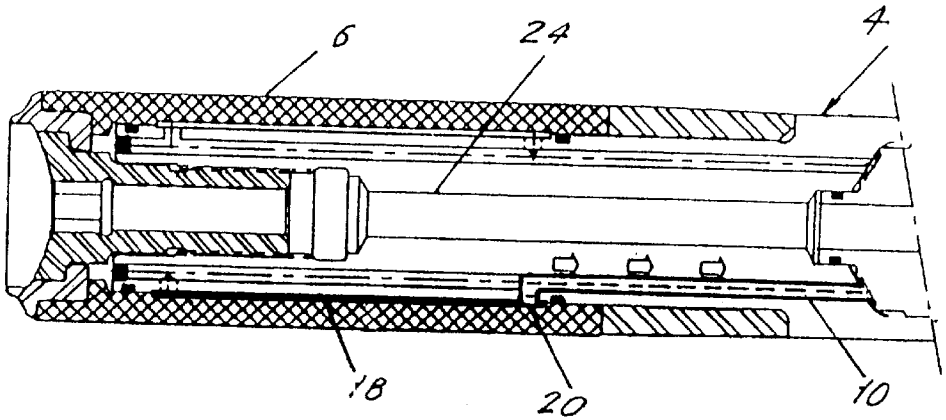
FIG. 8 is an enlarged view of the distal end of a punch assembly as shown in FIG. 2 and illustrating cooling media discharge from the punch.
Figure 6:
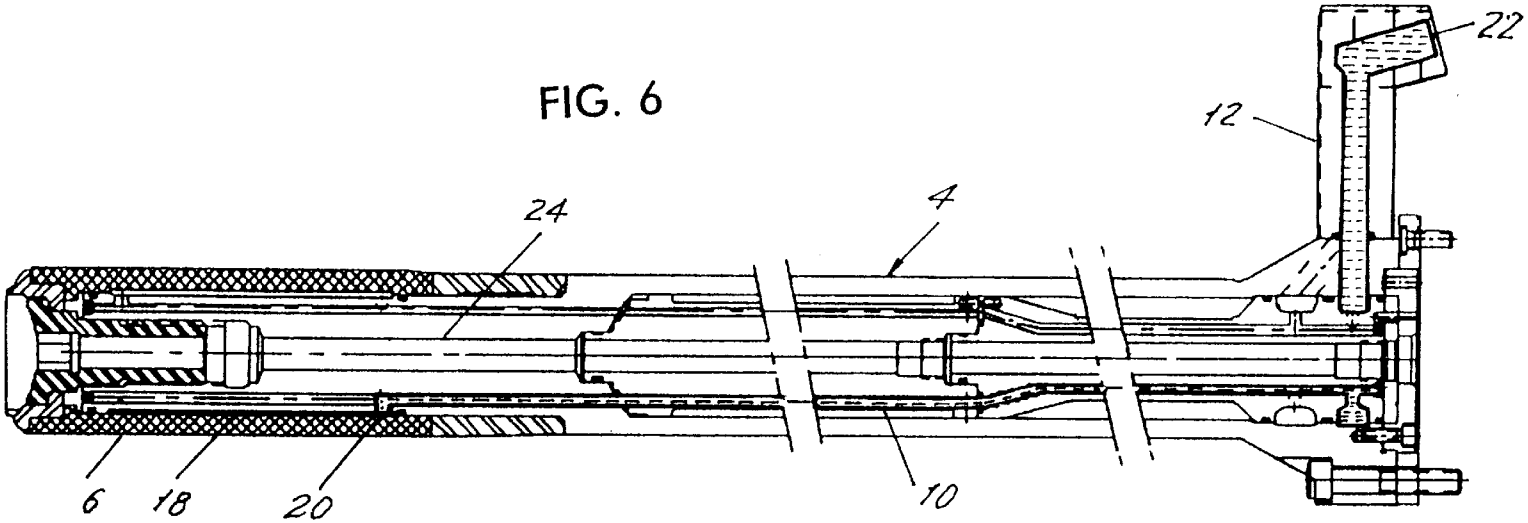
FIG. 6 is a cross section of the punch assembly of FIG. 1 showing fluid cooling medium discharge pathways.
Figure 7:
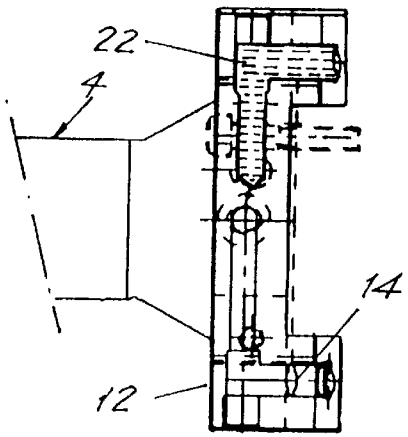
FIG. 7 is a cross sectional plan view detailing an outlet manifold of the punch assembly of FIG. 1.

FIGS. 6–8 show the discharge of the cooling medium from the punch. FIG. 6 illustrates the flow of cooling medium from the proximal end of the clearance or channel 18, radially through an outlet port 20 exiting channel 18 to an outlet 22 of the manifold 12. The cooling medium flows rearward or proximally along outlet transfer tube 10, with the direction of outlet flow indicated by the arrows in FIG. 8.

FIG. 5 shows that the respective pluralities of inlet 8 and outlet tubes 10 are provided in ram 4 in an alternating annular arrangement. Similarly, inlet ports 16 and outlet ports 20 to fluid channel 18 are provided in a symmetrical, annular arrangement to distribute the cooling medium uniformly to the inner surface of the punch. The clearance or channel 18 may comprise a series of individual partially circumferential passages or channels or a single circumferential channel around the inside of the punch with spaced supports for the punch located in that clearance. Since the respective inlet 8 and outlet 10 tubes are circumferentially offset, either the clearance is circumferentially large enough and/or the inlet and outlet ports 16 and 20 are angled such that medium will flow inside the punch as described.

Fluid transfers tubes 8 and 10 are formed of materials with low thermal transfer properties to minimize heat transfer between the fluid medium and the ram, to maintain accurate fluid medium inlet temperatures and to minimize ram distortion due to circumferential thermal gradients. Such thermal gradients would be adverse to maintaining the straightness of the ram. The temperature of the ram is cooled by the fluid medium, and cooled uniformly to maintain straightness. Furthermore, the fluid may also be heated to warm the ram, for example at machine startup. This may be desired to minimize thermal expansion effects and improve the drawing, ironing and stripping processes.

To maintain a correct temperature level, the temperature of the punch may be continuously monitored by a thermometer probe 23 communicating with the punch 6 near the distal end thereof, e.g. at the exterior or at the interior of the punch, at the exterior of the ram or monitoring the temperature of the liquid in the clearance 18.

A separate central port 24 disposed axially in ram 4 is used for air flow to aid in stripping the formed container from the punch.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A punch assembly for producing a container body by driving a formidable cup through a ring type die means, the punch assembly comprising:

a ram having proximal and distal ends;

a punch disposed over the distal end of the ram, the punch having an internal surface;

a manifold connected to the proximal end of the ram;

an annular array of circumferentially spaced fluid inlet tubes in the ram for supplying cooling fluid medium from the manifold toward the distal end of the ram; and a plurality of radial inlet ports from the inlet tubes to the internal surface for supplying the cooling medium to the internal surface of the punch;

an annular array of circumferentially spaced fluid outlet tubes in the ram for removing cooling medium;

a plurality of radial outlet ports from the internal surface, and spaced from the inlet ports along the length of the ram for transferring cooling medium from the internal surface of the punch to the outlet tubes.

2. The punch assembly of claim 1, wherein the inlet ports are more distal and the outlet ports are more proximal along the ram, with the internal surface defining a clearance between each inlet port and at least one outlet port.

3. The punch assembly of claim 1, wherein the annular arrays of inlet tubes and outlet tubes are arranged with the inlet and outlet tubes alternating.

4. The punch assembly of claim 3, wherein the inlet and outlet tubes are parallel.

5. The punch assembly of claim 1, wherein the punch has a proximal end and the outlet ports are near the proximal end of the punch.

6. The punch assembly of claim 1, further comprising a central port in the ram for air flow to aid in stripping the container from the punch.

7. The punch assembly of claim 1, further comprising a temperature control unit for supplying the cooling medium into the manifold.

8. The punch assembly of claim 7, further comprising means for monitoring the external temperature of the punch for controlling the cooling medium temperature.

9. The punch assembly of claim 1, wherein the transfer tubes are constructed from materials having low thermal transfer properties.

10. The punch assembly of claim 3, wherein the inlet and outlet tubes alternate in a symmetrical annular arrangement for uniform distribution of cooling medium to the internal surface.

11. The punch assembly of claim 5, wherein the punch has a distal end and the inlet tubes are near the distal end of the punch.

12. The punch assembly of claim 1, wherein the punch has a proximal end and a distal end, one of the inlet and the outlet ports being near the proximal end of the punch and the other of the ports being at the distal end of the punch.

* * * * *